US005722385A

United States Patent [19]

Bunk

[11] Patent Number: 5,722,385

[45] Date of Patent: Mar. 3, 1998

[54] BUSS CABLE POSITIONER FOR COMPOUND BOWS

[75] Inventor: Paul H. Bunk, 1738 Welling, Troy, Mich. 48098

[73] Assignees: Paul H. Bunk, Troy; Peter D. Keefe, Roseville, both of Mich.

[21] Appl. No.: 801,772

[22] Filed: Feb. 18, 1997

[51] Int. Cl.[6] ..... F41B 5/10

[52] U.S. Cl. ..... 124/86; 124/25.6

[58] Field of Search ..... 124/23.1, 25.6, 124/86, 90

[56] References Cited

U.S. PATENT DOCUMENTS

| | | | |
|---|---|---|---|
| 2,714,377 | 8/1955 | Mulkey | 124/25.6 X |
| 3,851,638 | 12/1974 | Alexander | 124/25.6 |
| 3,989,026 | 11/1976 | Nishioka | 124/86 X |
| 4,203,412 | 5/1980 | Rickard | 124/90 X |
| 4,461,267 | 7/1984 | Simonds et al. | 124/25.6 |
| 4,519,374 | 5/1985 | Miller | 124/25.6 |
| 4,562,824 | 1/1986 | Jennings | 124/25.6 |
| 4,570,606 | 2/1986 | Peck | 124/25.6 |
| 4,662,344 | 5/1987 | Mitchell | 124/22 |
| 4,705,015 | 11/1987 | Troncoso, Jr. | 124/25.6 |
| 4,718,397 | 1/1988 | Remick | 124/25.6 |
| 4,817,580 | 4/1989 | Butterfield | 124/25.6 |
| 4,834,061 | 5/1989 | Chattin | 124/86 |
| 4,903,677 | 2/1990 | Colley et al. | 124/25.6 |
| 4,917,070 | 4/1990 | Townsend | 124/25.6 X |
| 4,919,108 | 4/1990 | Larson | 124/25.6 X |
| 4,971,020 | 11/1990 | Soderstrom et al. | 124/23.1 |
| 5,054,463 | 10/1991 | Colley et al. | 124/25.6 |
| 5,353,777 | 10/1994 | Fincher | 124/16 |
| 5,503,135 | 4/1996 | Bunk | 124/16 |

OTHER PUBLICATIONS

Bow Hunting Equipment Buyers Guide V.45 No. 4 of Ehlert Publishing Group, Inc., Minnetonka, MN 55035; 1996.

"Mathews Solocam" Compound Bow Brochure of Mathews Archery Sparta, WI 54656; Date Not Specified, Believed Dated Early 1996.

*Primary Examiner*—John A. Ricci

*Attorney, Agent, or Firm*—Peter D. Keefe

[57] ABSTRACT

A torqueless buss cable positioner for a compound bow, whereby the buss cables are displaced from the bow plane, yet, optimally, the buss cables do not subject the limbs to any force component perpendicular to the bow plane. The present invention provides two mutually spaced apart outboard guidance locations of the buss cables such that the limbs are not subjected to a force component perpendicular to the bow plane. In the preferred embodiment, this feature is provided by the location of the first and second pulley sets. Further, the present invention provides an inboard guidance location of the buss cables between the outboard guidance locations, whereby the buss cables are laterally displaced a sufficient length from the bow plane to get the buss cables out of the way of the arrow at its nocking location. In the preferred embodiment, this feature is provided by the location of the third pulley set. In order for the present invention to function with varying amounts of draw of the bowstring, the outboard and inboard guidances are biasably pivoted to accommodate cam induced travel of the buss cables. In the preferred embodiment, this feature is provided by spring biased first and second pivots of the frame with respect to the bow member.

16 Claims, 4 Drawing Sheets

BUSS CABLE POSITIONER FOR COMPOUND BOWS

BACKGROUND OF THE INVENTION

1. Field of the Invention

The present invention relates to compound bows used in archery, including dual and single cam compound bows. More particularly the present invention relates to a buss cable positioner for laterally locating the buss cables out of the way of the area of space used for the arrow and for sighting. Still more particularly, the present invention relates to a buss cable positioner which eliminates limb torquing.

2. Description of the Prior Art

Simple archery bows are composed of a bow member (or back) characterized by a handle having connected thereto on each side thereof a flexibly resilient limb, and a bowstring connected with opposite ends of the bow member. The archer places the hock of an arrow against the nocking point of the bowstring and then draws the bowstring, thereby causing the bow member to resiliently flex at the limbs. This flexing of the bow member supplies tension to the bowstring and stores potential energy (draw energy). When the bowstring is released, the tension of the bowstring applies a force to the arrow, whereupon the potential energy of the bow member is captured by the arrow in the form of kinetic energy. While such an archery bow has the advantage of being simply constructed, it suffers from the need of the archer to continuously supply draw pull to keep the bow member resiliently flexed. Another serious disadvantage is the essentially instantaneous application of bowstring force upon the arrow at the moment the bowstring is released, with consequent degredation of accuracy due to the imparted shock. An improved example of a simple archery bow using springs to reduce bowstring shock is described in U.S. Pat. No. 4,570,606 to Peck.

These problems have been addressed in the past with varying degrees of success, wherein it is an object to provide an archery bow having a draw pull let-off feature, while yet providing a high level of draw energy for imparting ample speed to the arrow when released.

In this regard, compound archery bows have been devised toward addressing these objects, generally utilizing a rigging of the bowstring with respect to one or more cams or pulleys which are rotatively mounted with respect to the bow member via buss cables. As the bowstring is pulled back, the limbs of the bow member are caused to resiliently flex, while rotation of the cams or pulleys as the bowstring is pulled back causes the force on the bowstring to be high during pull back of the bowstring and then let-off as the maximum draw point is achieved. Examples of such compound bows are described in U.S. Pat. No. 4,718,397 to Remick, U.S. Pat. No. 4,461,267 to Simonds et al, U.S. Pat. No. 4,562,824 to Jennings, and U.S. Pat. No. 4,519,374 to Miller. Imaginative and interesting variations on this principle are found in U.S. Pat. No. 5,045,463 to Colley et al, U.S. Pat. No. 4,817,580 to Butterfield, U.S. Pat. No. 3,851,638 to Alexander, and U.S. Pat. No. 2,714,377 to Mulkey.

As the bowstring is drawn, the limbs of the bow resiliently bend in a bow plane which bisects the bow member. The arrow, bow sights, and bowstring are all located in, or closely centered in, this plane; and, problematically, so, too, are the buss cables. While the nock of the arrow engages the nocking point of the bowstring so that there is no conflict in position therebetween, this is not the case for the buss cables. Since the buss cables fall in the bow plane between the bowstring and the bow member, they conflict positionally with the arrow and the bow sights. Accordingly, it is necessary to move the buss cables laterally with respect to the bow plane so that they are out of the way of the arrow and the bow sights.

FIGS. 1 and 1B depict a conventional compound bow 10. The bowstring 12 is strung between the limbs **16*a*, 16*b* of the bow member 14. The bowstring 12 lies substantially on the bow plane P (see FIG. 1B), wherein the bow plane is aligned with the bowstring and bisection of the bow member 14. Buss cables 18*a*, 18*b* are positioned between the bow member 14 and the bowstring 12 in a narrow zone centered on the bow plane P. The buss cables 18*a*, 18*b* are laterally repositioned a distance D (see FIG. 1B) with respect to the bow plane P via a slide-type positioner 20 in order to get the buss cables out of the way of the arrow and the sights of the compound bow at the arrow nocking point a lateral distance D'. The rod 22 of the slide-type buss cable positioner 20 is connected with the bow member 14 and is located at a position laterally displaced with respect to the bow plane P (wherein in FIG. 1B the bow plane is at the bowstring). The slide 24 of the slide-type positioner 20 has a concave rod seat which slidingly interfaces with the rod 22. Opposite the rod seat, the slide 24 has two concave cable guides for receiving, respectively, each of the buss cables 18*a*, 18*b*** at the desired distance D from the bow plane.

In operation, as the bowstring is drawn back, the buss cables interact with the cam 26 (or cams in two cam compound bows) to cause the limbs to be resiliently bent toward each other in the bow plane. The buss cables are prevented from encroaching too near the bow plane by action of the slide-type positioner 20, so that an arrow and the sights of the compound bow are not interfered therewith.

Problematically, however, the buss cables have been forced laterally with respect to the bow plane by the slide-type positioner 20. This lateral displacement results in a force F perpendicular to the bow plane P (see FIG. 1B). This perpendicular force F is transmitted in one direction to the handle of the bow member 14 and in the opposite direction to the limbs **16*a*, 16*b*, resulting in a limb torque off the bow plane P. This limb torque results in inaccuracy in arrow aiming, since the bowstring is not precisely being tensioned in the bow plane by the limbs. Further, the slide-type positioner 20** suffers from associated vibration, noise and frictionally introduced hesitation effects as the slide moves along the rod (see arrow S) in concert with buss cable travel associated with the peripheral contact of the buss cables with the cam(s).

Accordingly, what is needed in the art is a positioner for buss cables which effects lateral repositioning of the buss cables, but, optimally, does not introduce any limb torque.

SUMMARY OF THE INVENTION

The present invention is a torqueless buss cable positioner for a compound bow, whereby the buss cables are displaced from the bow plane, yet, optimally, the buss cables do not subject the limbs to any force component perpendicular to the bow plane.

The torqueless buss cable positioner according to the present invention provides a guided path for the buss cables which includes an outboard guidance component for guiding the buss cables generally in the bow plane and an inboard guidance component for guiding the buss cables laterally off from the bow plane. The outboard guidance component optimally ensures that the limbs are not subjected by the buss cables to any component of force perpendicular to the bow plane, and the inboard guidance component ensures that the buss cables are laterally displaced in relation to the bow plane sufficiently to be out of the way of the arrow and the sights of the compound bow.

The preferred embodiment of the torqueless buss cable positioner is characterized by a guide member mounted to the bow member, wherein the guide member includes a frame, a first pulley set connected to one end of the frame, a second pulley set connected to the other end of the frame, and a third pulley set connected preferably medially to the frame. The frame is shaped, such as for example by a curve, whereby the first and second pulley sets mutually define an alignment axis, but the third pulley set is laterally displaced relative to the alignment axis. The frame is optimally structured and mountably positioned relative to the bow member so that the grooved periphery of each of the first and second pulley sets is located generally at the bow plane and the grooved periphery of the third pulley set is laterally displaced off from the bow plane a distance determined by the required buss cable displacement for the particular compound bow to which the torqueless tension cable positioner is utilized.

As the bowstring is drawn back, the entry location of the buss cables at the groove periphery of the cam(s) of the compound bow change in distance from the axis of rotation of the cam(s) at the limb(s). Accordingly, the frame is pivotally mounted to the bow member so that the pulley sets can follow the resulting travel of the buss cables. The pivotability of the frame relative to the bow member is provided by pivotal connection of the frame to a mounting bracket which is, in turn, mounted to the bow member. Preferably, the mounting bracket is, itself, pivotally mounted to the bow member. It is further preferred for each frame/bracket pivot to be resiliently biased in a direction of increasing cam bias on the bowstring as the bowstring is drawn. In this regard, the resilient biasing of the frame/bracket pivots serves to not only aid pulley alignment with the buss cables, but serves to increase bowstring energy transferred to an arrow.

Accordingly, it is an object of the present invention to provide a torqueless buss cable positioner for compound bows, whereby the buss cables are laterally displaced with respect to the bow plane, yet, optimally, the limbs of the bow are not subjected to a perpendicular component of force by the buss cables.

It is an additional object of the present invention to provide a torqueless buss cable positioner for compound bows, wherein a guide member is pivotally mounted with respect to the bow member for following the travel of the buss cables as the bowstring is drawn.

It is another object of the present invention to provide a torqueless buss cable positioner for compound bows, wherein a guide member is pivotally mounted with respect to the bow member for following the travel of the buss cables as the bowstring is drawn, and wherein the pivotal mounting includes resilient pivot biasing in the direction of increasing cam bias on the bowstring as the bowstring is drawn.

It is yet a further object of the present invention to provide a torqueless buss cable positioner for compound bows, whereby the buss cables are laterally displaced with respect to the bow plane, yet, optimally, the limbs of the bow are not subjected to a perpendicular component of force by the buss cables, wherein the compound bow is light and the bowstring delivers high energy to the arrow with great accuracy, while involving very little bow noise and vibration.

These, and additional objects, advantages, features and benefits of the present invention will become apparent from the following specification.

DETAILED DESCRIPTION OF THE PREFERRED EMBODIMENT

Figure 1:
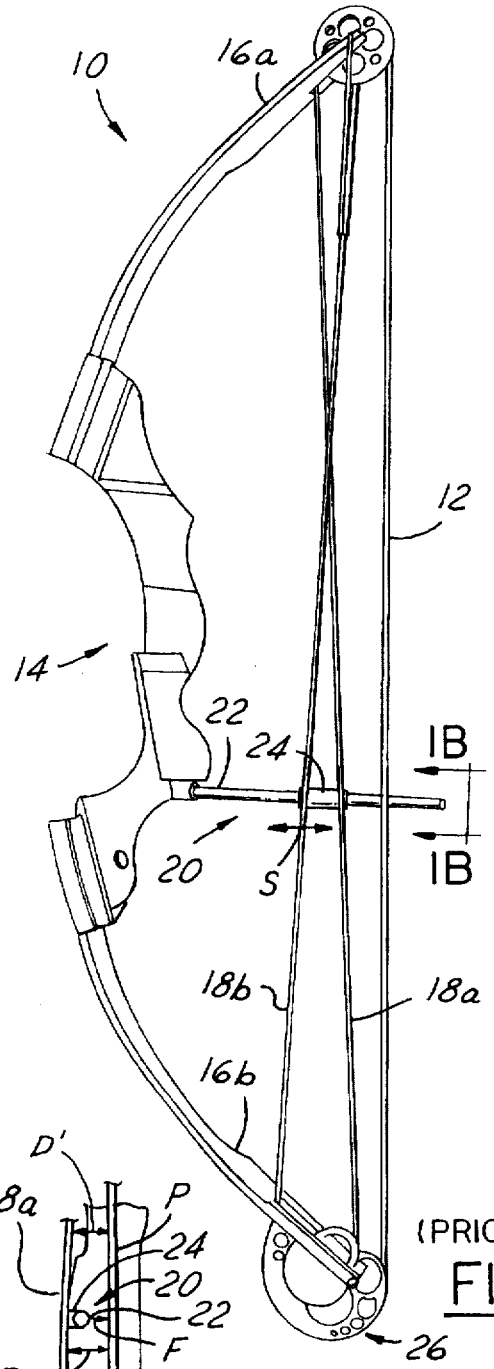
(PRIOR ART) FIG. 1
FIGS. 1 and 1B are depictions of a prior art compound bow having a conventional slide-type buss cable positioner.
Figure 1B:
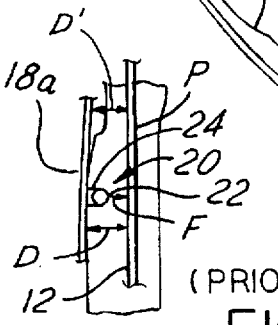
(PRIOR ART) FIG. 1B

Referring now to FIGS. 2 through 7 the torqueless buss cable positioner 100 according to the present invention will be described with reference to a double cam compound bow. It is to be understood that a double cam compound bow is shown merely by way of exemplification, and that the torqueless buss cable positioner is equally applicable to a single cam compound bow (of the type shown in FIG. 1, without, of course, the slide-type positioner 20).

Figure 2:
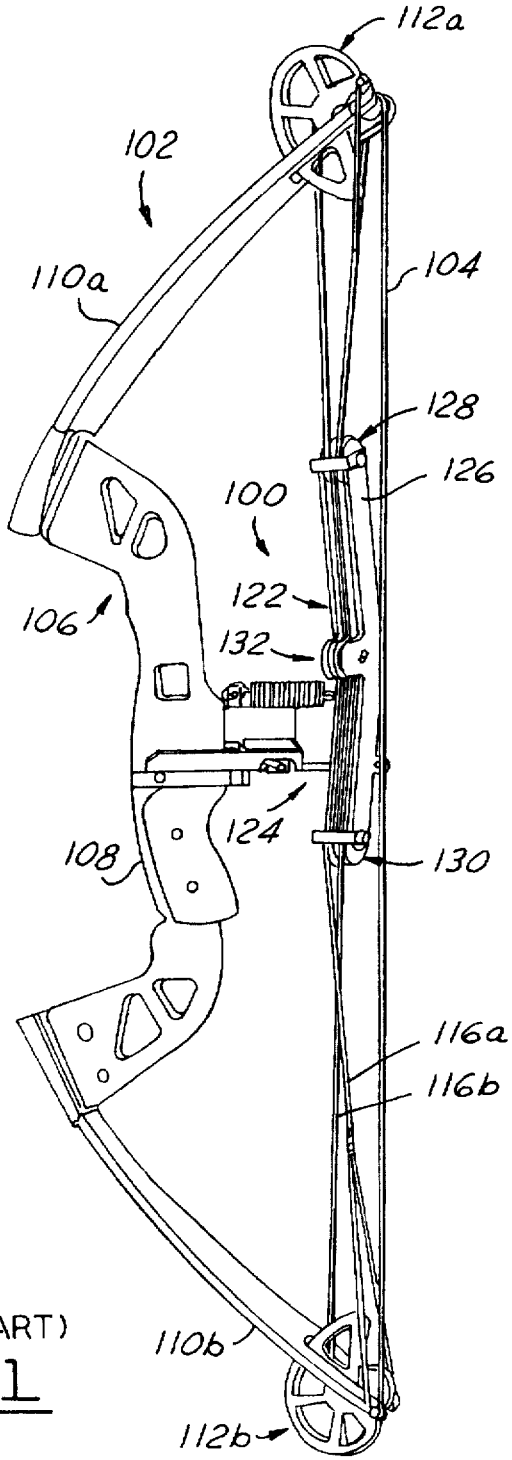
FIG. 2 is somewhat perspective, mainly side view of a compound bow equipped with the torqueless buss cable positioner according to the present invention, shown where the bowstring is at its rest position.
Figure 7:
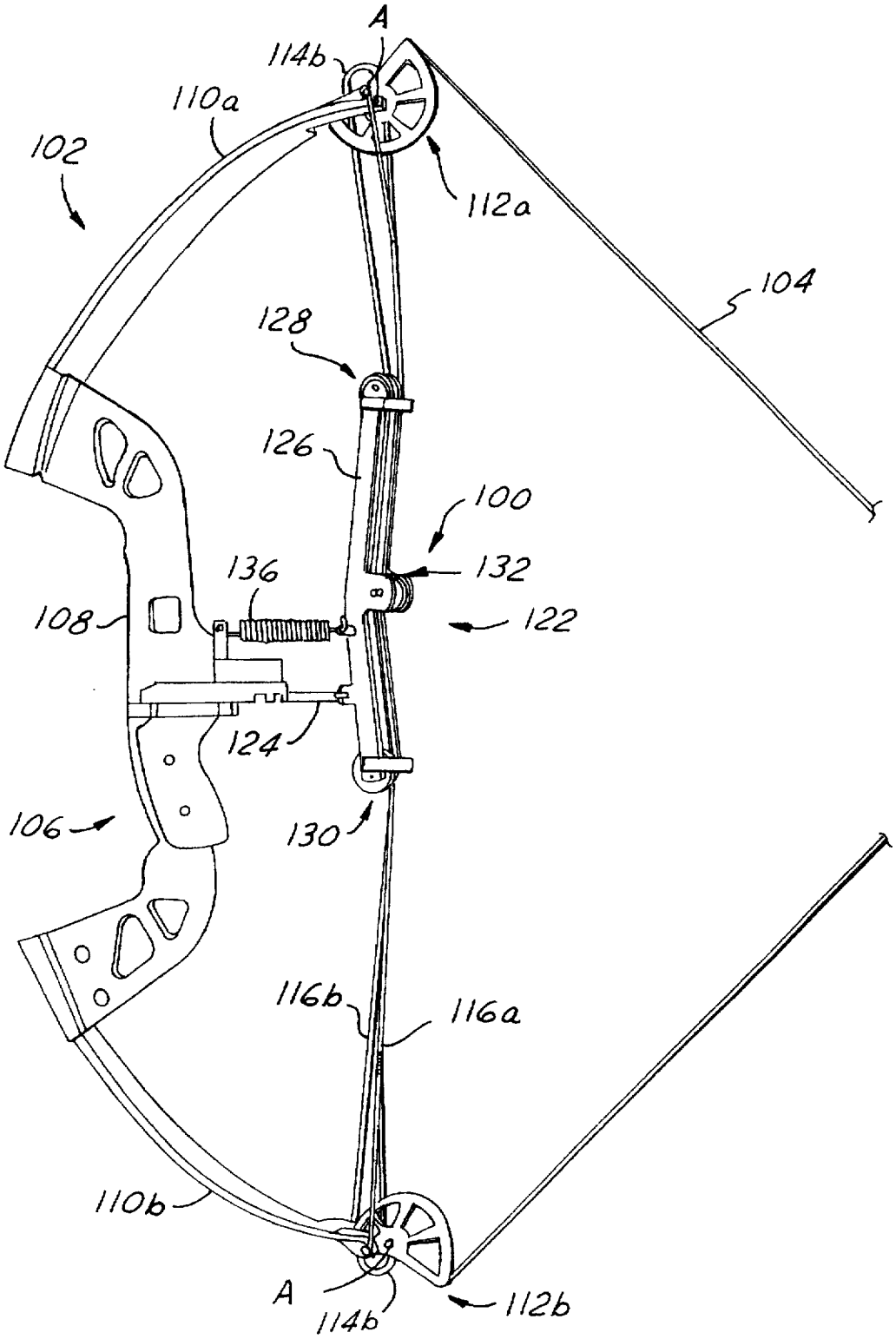
FIG. 7 is a somewhat perspective, mainly side view of a compound bow equipped with the torqueless buss cable positioner according to the present invention, shown where the bowstring is at its drawn position.

FIGS. 2 and 7 depict a compound bow 102 equipped with the torqueless buss cable positioner 100, wherein FIG. 2 depicts the configuration where the bowstring 104 is at its rest position, and FIG. 7 depicts the configuration where the bowstring is at its drawn position. It will be discerned that the compound bow 102 includes, conventionally, a bow member 106 having a handle section 108 and limbs 110*a*, 110*b* at either end of the handle section. Cams 112*a*, 112*b* are rotatably connected, respectively, to each end of the limbs 110*a*, 110*b*, wherein each cam rotates on a respective cam axis A (see FIG. 7). A bow plane BP of the bow member 106 is defined by a bisection of the bow member such that the curvature of the limbs 110*a*, 110*b* is in the bow plane (see FIGS. 4 and 5). The bowstring 104 is located substantially at the bow plane (see FIG. 3, where the bowstring is shown by way of example at the bow plane). Each end of the bowstring 104 is wound, respectively, on a first peripheral cam groove 114*a* and is then terminated on the respective cam 112*a*, 112*b*. The compound bow 102 further includes a pair of buss cables 116*a*, 116*b*, wherein, in respectively inverse arrangement, one end is fixedly connected with the end of a limb, as for example at a cam axis, while the other end is incipiently wound on a second peripheral cam groove 114*b*. The buss cables 116*a*, 116*b*, as shown at FIG. 4, are located in a narrow zone Z centered on the bow plane BP. The exact arrangement of the rigging of the bowstring and the buss cables may vary with particular compound bows (be that single or double cam), and the present description is merely for instructive exemplification.

In operation of the compound bow 102, when the bowstring 104 is drawn from its rest position as shown in FIG. 2 to its drawn position as shown in FIG. 7, the cams 112*a*, 112*b* rotate on their respective cam axis A as the bowstring unwinds off the first cam grooves 114*a*. Rotation of the cams 112*a*, 112*b* results in the buss cables 116*a*, 116*b* being wound onto their respective second cam grooves 114*b*. As a result, the limbs 110*a*, 110*b* are caused to be resiliently pulled toward each other in the bow plane BP thereby creating potential energy for propelling an arrow.

Figure 3:
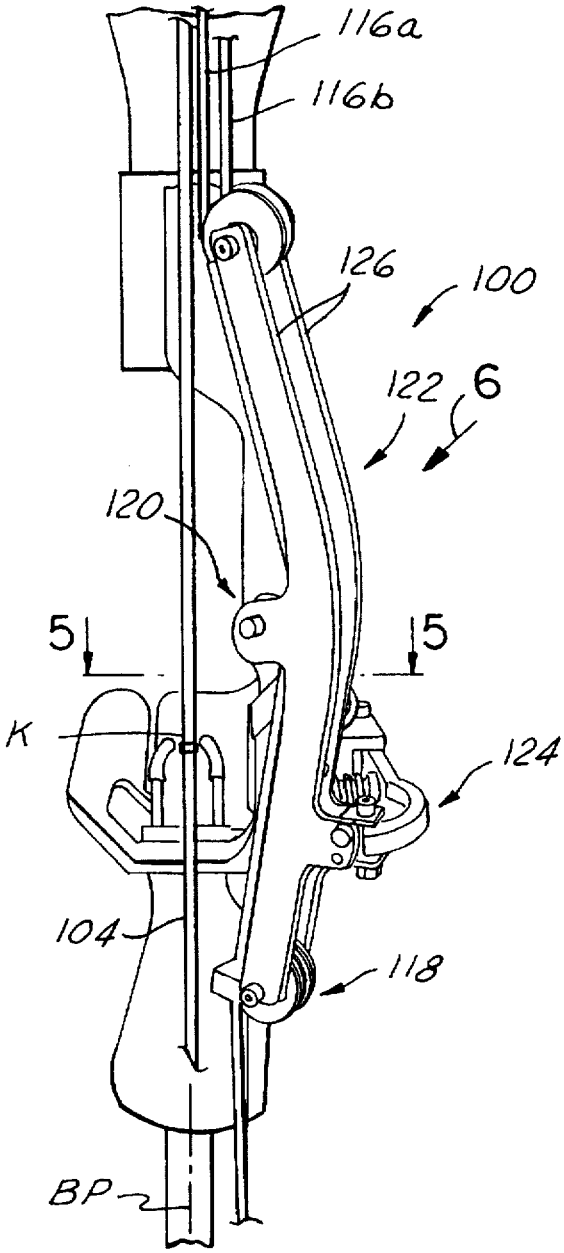
FIG. 3 is a partly broken away perspective view of a compound bow, where the torqueless buss cable positioner thereof is in particular shown, and wherein the torqueless buss cable positioner is shown at a position when the bowstring is at its rest position.
Figure 4:
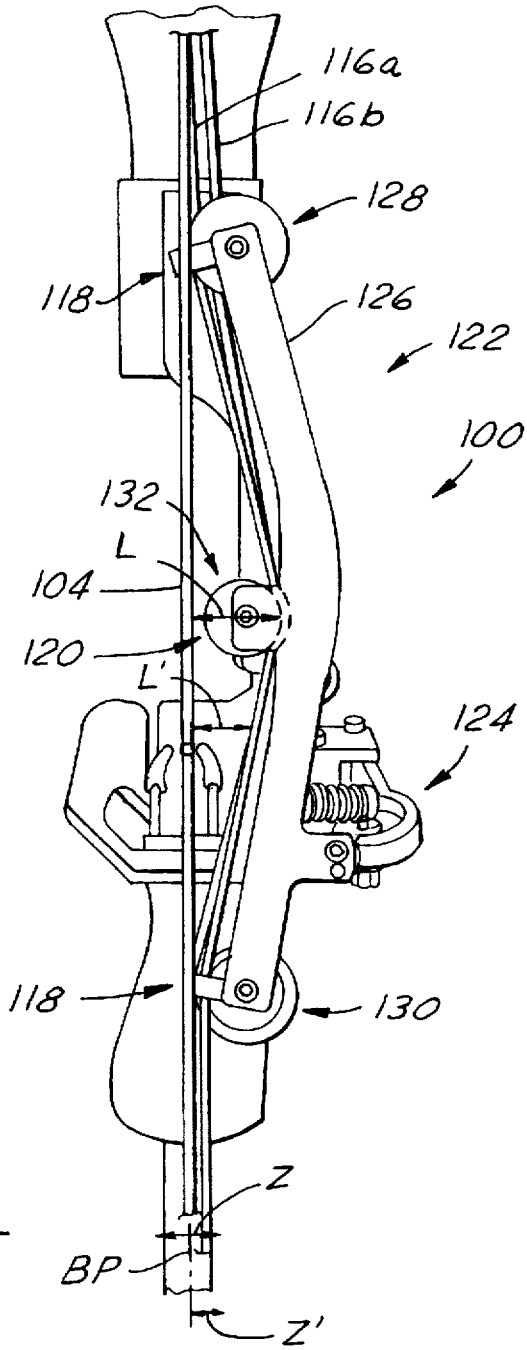
FIG. 4 is a partly broken away perspective view of a compound bow, where the torqueless buss cable positioner thereof is shown analogously to FIG. 3, but now the torqueless buss cable positioner is shown at a position when the bowstring is at its drawn position.
Figure 5:
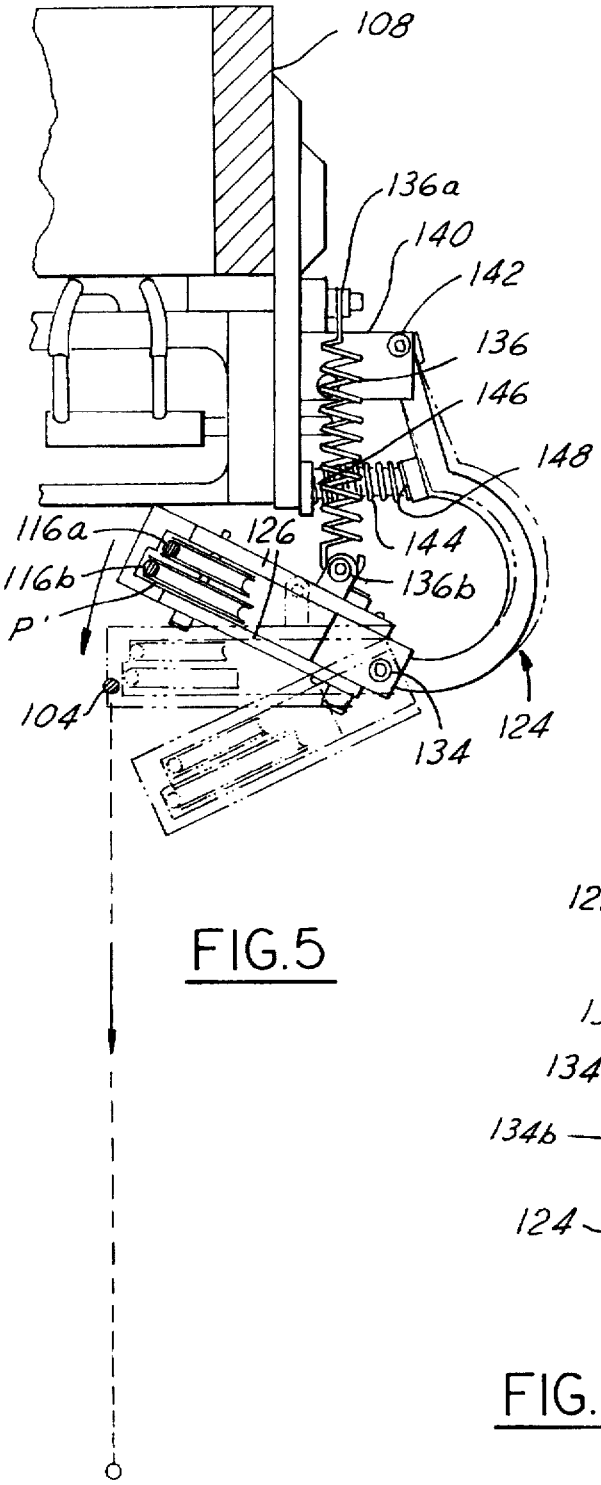
FIG. 5 is a partly sectional view of the compound bow with the torqueless buss cable positioner, seen along line 5—5 in FIG. 3.
Figure 6:
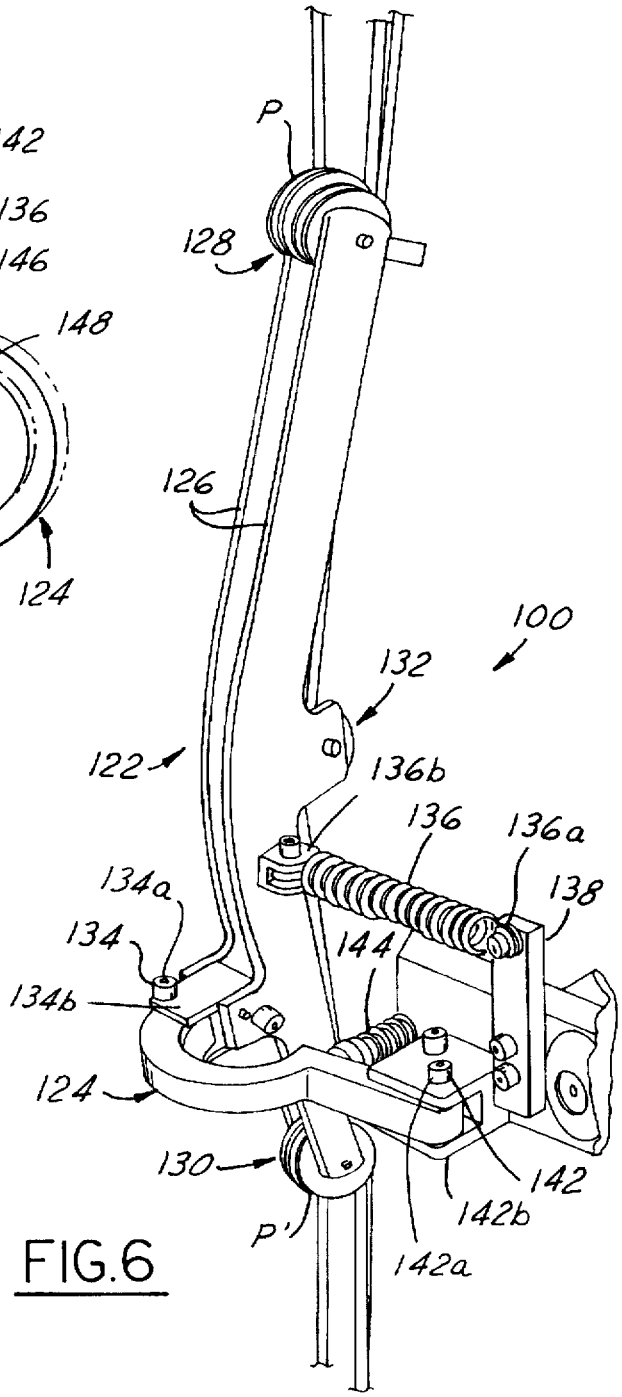
FIG. 6 is a partly broken away, perspective view of the compound bow with the torqueless buss cable positioner, seen along line 6 in FIG. 3.

It will be noted that the first cam grooves 114*a* place the bowstring 104 more-or-less at the bow plane, while the fixed connection and the second cam grooves 114*b* place the buss cables 116*a*, 116*b* somewhere within the zone Z in the vicinity of the arrow nocking location K (see FIG. 3). The small displacements of the buss cables and the bowstring is optimally symmetrically distributed in relation to the bow plane BP, so that no (or very little) perpendicular component of force is delivered to the limbs when the bowstring is drawn when the effects introduced by a buss cable positioner are ignored.

In order that the buss cables 116*a*, 116*b* not interfere with the arrow at the arrow nocking location K, it is necessary to reposition the buss cables laterally (perpendicularly) off the bow plane BP sufficiently so that they do not interfere with the arrow or sights of the bow member 102. As depicted in FIG. 4, the length of the displacement L is considerably larger than the maximum displacement Z' of the buss cables in the zone Z in the vicinity of the arrow nocking location K. For example, Z' could be about one-quarter inch and L could be about one and one-half inches which provides a displacement length L' of the buss cables of about three-quarters of an inch from the bow plane BP at the arrow nocking point K. Accordingly, the torqueless buss cable positioner 100 is employed to provide the necessary length of displacement L', while optimally ensuring that no perpendicular forces are applied to the limbs on account of the repositioning of the buss cables, as would occur with a conventional slide-type buss cable positioner.

The structure and function of the torqueless buss cable positioner 100 according to the present invention will now be more particularly detailed. In this regard, the torqueless buss cable positioner 100 provides a guided path for the buss cables 116*a*, 116*b* whereby an outboard guidance component 118 provides guiding of the buss cables in the zone Z and an inboard guidance component 120 provides guiding of the buss cables laterally off the bow plane by a length of displacement of at least L' (see FIG. 4). Optimally, the outboard guidance component 118 is aligned with the limbs 110*a*, 110*b* and the bow plane BP so that the limbs are not subjected by the buss cables 116*a*, 116*b* to any component of force perpendicular to the bow plane.

As depicted in FIGS. 2 through 7, the preferred embodiment of the torqueless buss cable positioner 100 is characterized by a guide member 122 pivotally mounted to the bow member 106 via a bracket 124. The guide member 122 includes an elongated frame 126 and first, second and third pulley sets 128, 130, 132 rotatably connected with the frame for rollingly guiding the buss cables 116*a*, 116*b*. Preferably, the rotatable connection of the pulleys to the frame 126 is provided by ball bearings. The first pulley set 128 is connected to one end of the frame 126; the second pulley set 130 is connected to the other end of the frame; and the third pulley set 132 is connected to the frame between the first and second pulley sets, preferably medially therebetween.

The frame 126 is shaped, preferably in the form of an arcing curvilinear shape, whereby the first and second pulley sets 128, 130 mutually define an imaginary alignment axis therebetween, but the third pulley set 132 is laterally displaced relative to the alignment axis. The frame 126 is mountably positioned relative to the bow member 106 so that the grooved periphery of each of the first and second pulley sets 128, 130 is located in the zone Z narrowly centered on the bow plane BP, while the grooved periphery of the third pulley set 132 is laterally displaced off the bow plane the displacement distance determined by the required buss cable displacement for the particular compound bow to which the torqueless tension cable positioner is utilized. In the preferred embodiment shown in the Drawing, the third pulley set 132 is not located adjacent the arrow nocking point K; consequently, the buss cables are displaced the needed distance L' by providing a displacement distance of the third pulley set a distance L, which is greater than L', as measured from the bow plane BP.

With regard to each of the first, second and third pulley sets 128, 130, 132, two pulleys are provided, one, respectively, for each buss cable 116*a*, 116*b*. Where only one or more than two buss cables are present, then the number of pulleys is similarly present for respectively receiving each buss cable. While the diameter of the pulleys of the third pulley set 132 may be the same, this is not necessarily the case with the first and second pulley sets 128, 130. As depicted best by FIG. 6, a pulley P at one side of the frame 126 of the first pulley 128 set has a diameter larger than its companion, while a pulley P' at the other side of the frame of the second pulley set 130 is larger than its companion. This inverse arrangement of larger and smaller pulleys of the first and second pulley sets 128, 130 aids in reducing limb torque and ensures efficient buss cable guidance.

The bracket 124 is pivotally connected to the frame 126 at a first pivot 134 via a pivot pin 134*a* and clevis 134*b* connected with the frame. The first pivot 134 is generally perpendicular to the axes of rotation of the pulleys of the first, second and third pulley sets 128, 130, 132. A first tension spring 136 extends between the frame 126 and the handle 106 via a stand-off 138. The first tension spring 136 is pivotable at each of its connections 136*a*, 136*b* to the frame 126 and the handle section 106, respectively, so that the first tension spring is not bendably distorted as the frame pivots on the first pivot 134. The direction of the biasing of the first tension spring 136 is compressibly between the handle section 106 and the frame 126, whereby the biasing of the first tension spring on the frame 126 is in the same direction as that of increasing biasing of the cams 112*a*, 112*b* on the buss cables 116*a*, 116*b* as the bowstring 104 is drawn. Accordingly, the first tension spring 136 adds potential energy to the compound bow 102 when the bowstring 104 is drawn, and, consequently, contributes to the propelling energy imparted to an arrow when the bowstring is released.

Preferably, a second pivot 138 is provided, whereby the bracket 124 is pivotally connected with the handle section 106. The second pivot 138 is parallel with respect to the first pivot 134 so that as the frame pivots on the first pivot 134, the location of engagement of the first and second pulley sets 128, 130 with the buss cables 116*a*, 116*b* is kept within the zone Z. A preferred structure for the second pivot 142 is a clevis 142*a* connected with the handle section 106 into which one end of the bracket 124 is pivotally mounted on a pivot pin 142*b*. It is further preferred for a second tension spring 144 to bias the bracket 124 in a direction substantially laterally away from the bow plane BP. In this regard, the second tension spring 144 is compressed between a first contact location 146 on the handle section 106 and a second contact location 148 on the bracket 124 (see FIGS. 5 and 6.)

In operation, as the bowstring is drawn back, the entry location of the buss cables at the respective groove periphery of the cams change in distance from their respective axis of rotation A. Accordingly, the frame pivots via the first and second pivots as the first and second pulley sets follow the resulting travel of the buss cables. The resilient biasing provided by the first and second tensioning springs serve to not only aid pulley alignment with the buss cables, but serve to increase bowstring energy transferred to an arrow.

It will be understood that the concept of the present invention is to provide mutually spaced apart outboard guidance locations of the buss cables such that the limbs are not subjected to a force component perpendicular to the bow plane. In the preferred embodiment, this feature is provided by the location of the first and second pulley sets. It is further the concept of the present invention to provide an inboard guidance location of the buss cables between the outboard guidance locations, whereby the buss cables are laterally displaced a length L' from the bow plane BP which is needed to get the buss cables out of the way of the arrow at its knocking location K. In the preferred embodiment, this feature is provided by the location of the third pulley set. In order for the concept of the present invention to function with varying amounts of draw of the bowstring, the outboard and inboard guidances are pivoted to accommodate cam induced travel of the buss cables. In the preferred embodiment, this feature is provided by the first and second pivots of the frame with respect to the bow member.

It is to be further understood that an important concept of the present invention is to resiliently bias the buss cables via a buss cable positioner, such that the biasing of the buss cable positioner is additive with the biasing provided by the cam or cams as the bowstring is drawn. In the preferred embodiment, this feature is provided by the first and second tension springs 136, 144, whereby the first and second tension springs add potential energy to the limb bend potential energy of the compound bow as the bow string is drawn. This amplified potential energy imparts a higher arrow velocity upon release of the bowstring than would be the case if the buss cable positioner was not resiliently biased. Interestingly, this concept is adaptable to any buss cable positioner by simply resiliently biasing the component thereof in contact with the buss cables. For example, this feature can be present whether or not the frame is shaped to provide zero limb torque. Further for example, the slide of a slide-type buss cable positioner may be resiliently biased relative to the rod in the direction of increasing cam biasing. An example of a structure to implement this feature could be a spring stopped at one end thereof on a washer which is affixed to the rod, wherein the spring biases the slide at the other end thereof.

As indicated hereinabove, while the torqueless buss cable positioner 100 has been described in relation to a two cam compound bow, the over-all discussion thereof remains substantially the same with regard to a single cam compound bow, the rigging being now particular thereto, wherein FIGS. 3 through 6 are analogously descriptive of the torqueless buss cable positioner 100 used therewith. Accordingly, further discussion of the torqueless buss cable positioner 100 is unwarranted for those of ordinary in the archery art to understand its implementation on a single cam compound bow.

Further, while a right-hand compound bow has been shown in the Drawing, it is to be understood the torqueless buss cable positioner 100 is equally usable with a left-hand compound bow, wherein its arrangement relative to the bow member is inverse to the bow plane.

To those skilled in the art to which this invention appertains, the above described preferred embodiment may be subject to change or mortification. Such change or mortification can be carried out without departing from the scope of the invention, which is intended to be limited only by the scope of the appended claims.

What is claimed is:

1. A buss cable positioner for a compound bow, the compound bow having a bow member and at least one buss cable, said buss cable positioner comprising:

outboard guidance means for guiding at least one buss cable at two mutually spaced outboard locations, an imaginary axis extending between said outboard locations;

inboard guidance means for guiding the at least one buss cable at at least one location between said outboard locations displaced with respect to said imaginary axis; and connection means for connecting said outboard and inboard guidance means to a bow member.

2. The buss cable positioner of claim 1, where said connection means comprises pivot means for pivotally connecting said outboard and inboard guidance means to the bow member.

3. The buss cable positioner of claim 1, wherein said outboard and inboard guidance means comprise:

a frame;

first pulley means for guidably engaging said at least one buss cable, said first pulley means being rotatably connected to a first location of said frame;

second pulley means for guidably engaging said at least one buss cable, said second pulley means being rotatably connected to a second location of said frame; and third pulley means for guidably engaging said at least one buss cable, said third pulley means being rotatably connected to a third location of said frame between said first and second locations.

4. The buss cable positioner of claim 3, wherein said connection means comprises:

a bracket having a first end and an opposite second end;

means for connecting said first end to the bow member; and first pivot means for pivotally connecting said frame to said second end.

5. The buss cable positioner of claim 4, wherein said connection means further comprises first biasing means for resiliently biasing said frame with respect to the bow member.

6. The buss cable positioner of claim 5, wherein said connection means further comprises second pivot means for pivotally connecting said first end of said bracket to the bow member.

7. The buss cable positioner of claim 6, where said connection means further comprises second biasing means for resiliently biasing said bracket with respect to the bow member.

8. A compound bow comprising:

a bow member having an arrow nocking location, said bow member comprising:

a handle section having a first and and an opposite second end;

a first limb connected with said first end of said handle section;

a second limb connected with said second end of said handle section;

at least one cam connected with at least one of said first and second limbs;

a bowstring strung between said first and second limbs, said bowstring being windably connected with said at least one cam; and at least one buss cable strung between said first and second limbs, said at least one buss cable being windably connected with said at least one cam;

wherein said bow member is bisected by a bow plane, and wherein said stringing of said bow string and said at least one buss cable places said bowstring and said at least one buss cable in a zone centered on, and substantially proximate to, said bow plane at said arrow nocking location; and a buss cable positioner comprising:

outboard guidance means for guiding said at least one buss cable at two mutually spaced outboard locations, an imaginary axis extending between said outboard locations;

inboard guidance means for guiding said at least one buss cable at at least one inboard location between said outboard locations displaced with respect to said imaginary axis; and connection means for connecting said outboard and inboard guidance means to said bow member;

wherein said outboard locations are located within said zone, and wherein said at least one outboard location is located outside said zone.

9. The compound bow of claim 8, wherein said connection means comprises pivot means for pivotally connecting said outboard and inboard guidance means to said bow member.

10. The compound bow of claim 9, wherein said first and second locations are located with respect to said first and second limbs such that limb torque is substantially absent when said bowstring is drawn.

11. The compound bow of claim 8, wherein said outboard and inboard guidance means comprise:

a frame;

first pulley means for guidably engaging said at least one buss cable, said first pulley means being rotatably connected to a first location of said frame;

second pulley means for guidably engaging said at least one buss cable, said second pulley means being rotatably connected to a second location of said frame; and third pulley means for guidably engaging said at least one buss cable, said third pulley means being rotatably connected to a third location of said frame between said first and second locations.

12. The compound bow of claim 11, wherein said connection means comprises:

a bracket having a first end and an opposite second end;

means for connecting said first end to said bow member; and first pivot means for pivotally connecting said frame to said second end.

13. The compound bow of claim 12, wherein said connection means further comprises first biasing means for resiliently biasing said frame with respect to said bow member.

14. The compound bow of claim 13, wherein said connection means further comprises second pivot means for pivotally connecting said first end of said bracket to said bow member.

15. The compound bow of claim 14, wherein said connection means further comprises second biasing means for resiliently biasing said bracket with respect to said bow member.

16. The compound bow of claim 15, where said first and second locations are located with respect to said first and second limbs such that limb torque is substantially absent when bowstring is drawn.

* * * * *